US009740132B2

(12) United States Patent
Nakai

(10) Patent No.: US 9,740,132 B2
(45) Date of Patent: Aug. 22, 2017

(54) IMAGE FORMING APPARATUS, NON-TRANSITORY COMPUTER READABLE MEDIUM, AND IMAGE FORMING METHOD

(71) Applicant: FUJI XEROX CO., LTD., Tokyo (JP)

(72) Inventor: Daisuke Nakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/877,214

(22) Filed: Oct. 7, 2015

(65) Prior Publication Data

US 2016/0378009 A1 Dec. 29, 2016

(30) Foreign Application Priority Data

Jun. 26, 2015 (JP) ..... 2015-129066

(51) Int. Cl.
*G03G 15/01* (2006.01)
*G03G 15/00* (2006.01)

(52) U.S. Cl.
CPC ..... *G03G 15/0131* (2013.01); *G03G 15/6585* (2013.01); *G03G 15/0184* (2013.01)

(58) Field of Classification Search
CPC ..... G03G 15/0131
See application file for complete search history.

(56) References Cited

U.S. PATENT DOCUMENTS 9,383,689 B1 * 7/2016 Ikeda ..... G03G 15/0189
9,482,980 B1 * 11/2016 Watanabe ..... G03G 15/0131
2007/0242966 A1 * 10/2007 Itagaki ..... G03G 15/5062 399/49
2009/0220880 A1 * 9/2009 Moffat ..... C09C 1/0015 430/108.6
2012/0104661 A1 * 5/2012 Wu ..... G03G 15/1685 264/496
2013/0258367 A1 * 10/2013 Saito ..... G06K 15/14 358/1.9
2014/0147149 A1 * 5/2014 Kiuchi ..... G03G 15/2028 399/68
2014/0356035 A1 * 12/2014 Harashima ..... G03G 15/2039 399/321
2015/0098740 A1 * 4/2015 Yukie ..... G03G 15/6585 399/341
2015/0227076 A1 * 8/2015 Yuasa ..... G03G 15/0131 399/223

FOREIGN PATENT DOCUMENTS

JP 2006317632 A 11/2006

* cited by examiner

*Primary Examiner* — Walter L Lindsay, Jr.
*Assistant Examiner* — Arlene Heredia Ocasio
(74) *Attorney, Agent, or Firm* — Oliff PLC

(57) ABSTRACT

An image forming apparatus includes a first image forming unit that forms a metallic-color toner image having a metallic color, a second image forming unit that forms a non-metallic-color toner image having a color different from the metallic color, and a transfer unit that transfers the toner images onto a recording material so that the non-metallic-color toner image is superimposed on an upper side of the metallic-color toner image on the recording material.

7 Claims, 5 Drawing Sheets

IMAGE FORMING APPARATUS, NON-TRANSITORY COMPUTER READABLE MEDIUM, AND IMAGE FORMING METHOD

CROSS-REFERENCE TO RELATED APPLICATIONS

This application is based on and claims priority under 35 USC 119 from Japanese Patent Application No. 2015-129066 filed Jun. 26, 2015.

BACKGROUND

Technical Field

The present invention relates to an image forming apparatus, a non-transitory computer readable medium, and an image forming method.

SUMMARY

According to an aspect of the present invention, there is provided an image forming apparatus including a first image forming unit that forms a metallic-color toner image having a metallic color, a second image forming unit that forms a non-metallic-color toner image having a color different from the metallic color, and a transfer unit that transfers the toner images onto a recording material so that the non-metallic-color toner image is superimposed on an upper side of the metallic-color toner image on the recording material.

BRIEF DESCRIPTION OF THE DRAWINGS

An exemplary embodiment of the present invention will be described in detail based on the following figure, wherein.

DETAILED DESCRIPTION

An exemplary embodiment of the present invention will be described below with reference to the attached drawings.

Description of Image Forming Apparatus

Figure 1:
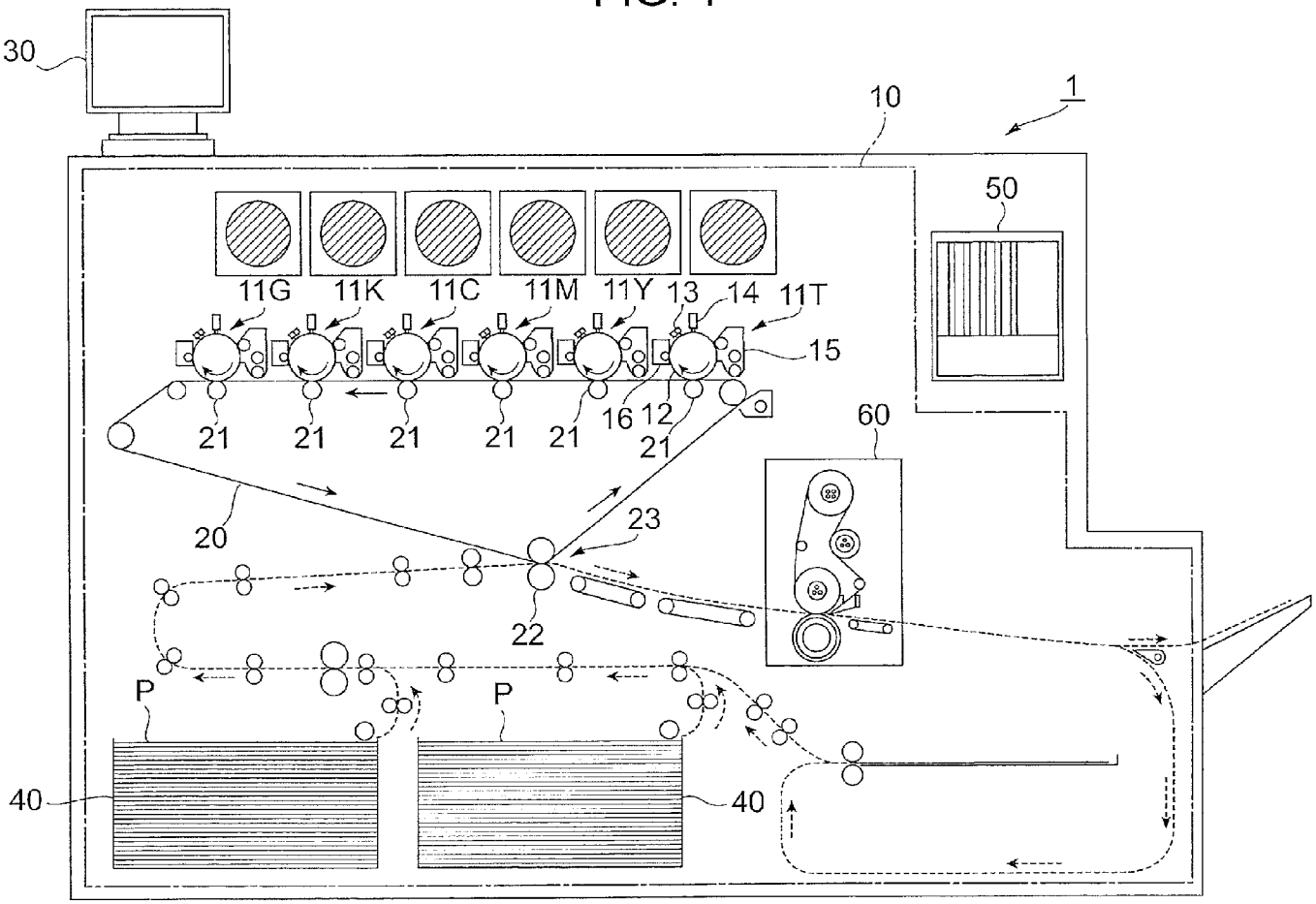
FIG. 1 illustrates a configuration example of an image forming apparatus according to an exemplary embodiment.

FIG. 1 illustrates a configuration example of an image forming apparatus 1 according to the exemplary embodiment.

The image forming apparatus 1 illustrated in FIG. 1 is a color printer of a so-called tandem type, and includes an image forming section 10 that performs image formation according to image data, a controller 50 that controls the operation of the entire image forming apparatus 1, performs communication with, for example, a personal computer, and executes image processing of the image data, and a user interface section 30 that receives operation input from the user and displays various information to the user.

Description of Image Forming Section

The image forming section 10 is a functional section that forms an image by, for example, an electrophotographic system. The image forming section 10 includes six image forming units, that is, an image forming unit 11Y for yellow (Y), an image forming unit 11M for magenta (M), an image forming unit 11C for cyan (C), an image forming unit 11K for black (K), an image forming unit 11T for a transparent color (T), and an image forming unit 11G for a metallic color (G).

In the following description, when the image forming units are not discriminated, they are generically referred to as "image forming units 11."

Each of the image forming units 11 includes, for example, a photoconductor drum 12 on which an electrostatic latent image is formed and color toner images are then formed, a charging device 13 that charges a surface of the photoconductor drum 12 with a predetermined potential, an exposure device 14 that exposes the photoconductor drum 12 charged by the charging device 13 according to image data, a developing device 15 that develops the electrostatic latent image formed on the photoconductor drum 12 with color toners, and a cleaner 16 that cleans the surface of the photoconductor drum 12 after transfer. The image forming units 11 have substantially similar structures except for toner contained in the developing device 15.

The image forming section 10 further includes an intermediate transfer belt 20 on which a color toner image formed on the photoconductor drum 12 in each image forming unit 11 is to be transferred, and first transfer rollers 21 each of which transfers (first-transfers) the color toner image formed in the image forming unit 11 onto the intermediate transfer belt 20. The image forming section 10 further includes a second transfer roller 22 that collectively transfers (second-transfers) color toner images superposed and transferred on the intermediate transfer belt 20 onto a sheet P, and a fixing unit 60 that fixes the second-transferred color toner images on the sheet P.

In the exemplary embodiment, a region where the second transfer roller 22 is disposed and the color toner images on the intermediate transfer belt 20 are second-transferred on the sheet P is referred to as a second transfer region 23 hereinafter.

In the exemplary embodiment, the intermediate transfer belt 20, the first transfer rollers 21, and the second transfer roller 22 function as an example of a transfer unit.

In the exemplary embodiment, the image forming unit 11G for a metallic color, the image forming unit 11K for black, the image forming unit 11C for cyan, the image forming unit 11M for magenta, the image forming unit 11Y for yellow, and the image forming unit 11T for a transparent color are arranged in this order from the downstream side to the upstream side with reference to the second transfer region 23 in the rotating direction of the intermediate transfer belt 20. In particular, the image forming unit 11G for the metallic color is disposed on the most downstream side with reference to the second transfer region 23 in the rotating direction of the intermediate transfer belt 20.

Description of Structure of Fixing Unit

Next, the fixing unit 60 used in the image forming apparatus 1 of the exemplary embodiment will be described.

Figure 2:
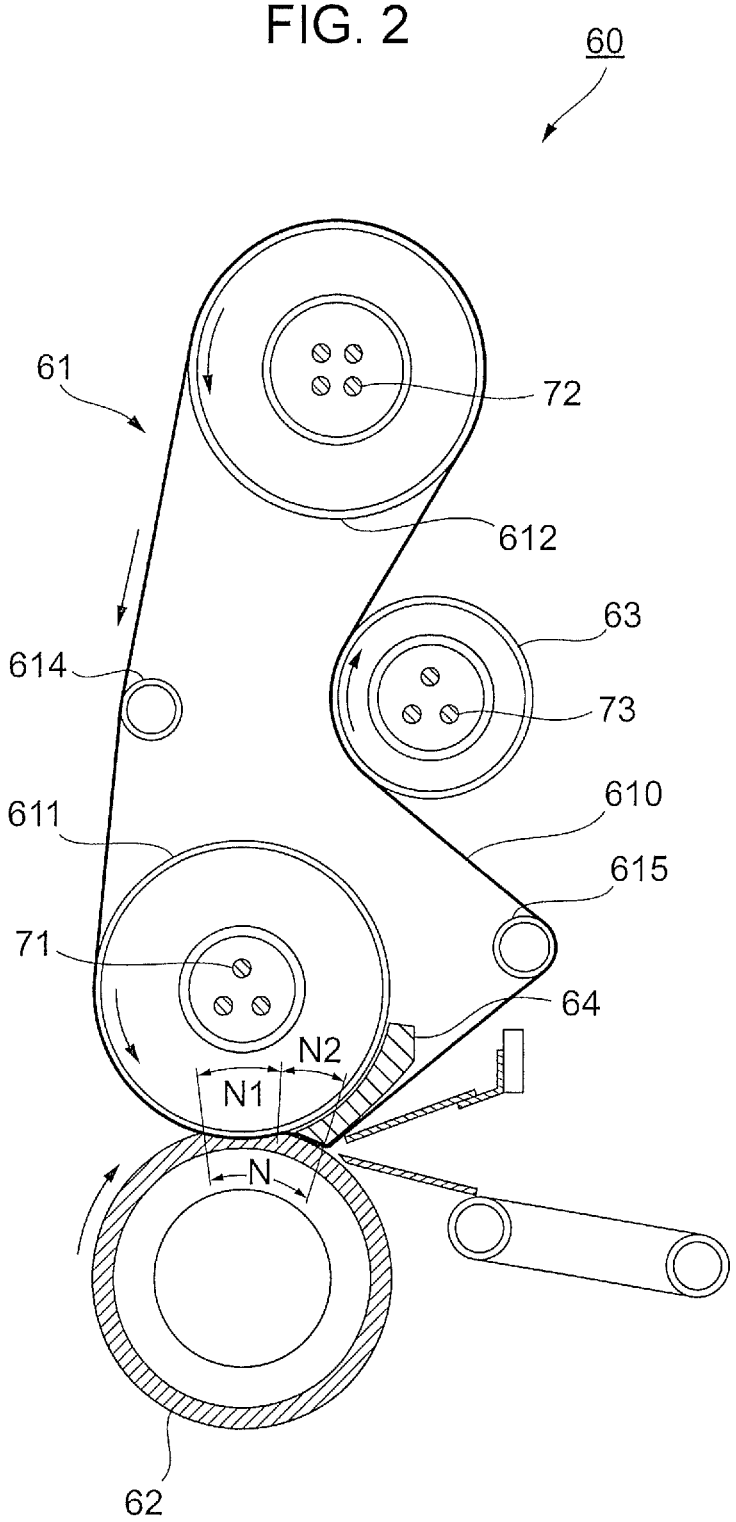
FIG. 2 is a cross-sectional structural view illustrating the structure of a fixing unit in the exemplary embodiment.

FIG. 2 is a cross-sectional structural view illustrating the structure of the fixing unit 60 in the exemplary embodiment.

As illustrated in FIG. 2, the fixing unit 60 includes a fixing belt module 61 that heats a sheet P, a pressing roller 62 configured to move into contact with and away from the fixing belt module 61, and an external heating roller 63 that heats a fixing belt 610 (to be described later) while stretching the fixing belt 610 from the outer side.

The fixing belt module 61 includes a fixing belt 610, and a fixing roller 611 that rotates while stretching the fixing belt 610 to heat the fixing belt 610 from the inner side at a nip N serving as a region where the fixing belt module 61 and the pressing roller 62 are in pressure contact with each other (are in contact while being pressed against each other).

The fixing belt module 61 further includes an internal heating roller 612 that heats the fixing belt 610. The fixing belt module 61 further includes a stretching roller 614 that stretches the fixing belt 610 between the fixing roller 611 and the internal heating roller 612 (on the upstream side of the nip N), a peeling pad 64 disposed within a downstream area of the nip N and near the fixing roller 611, and a stretching roller 615 that stretches the fixing belt 610 on the downstream side of the nip N.

For example, the fixing belt 610 is composed of a base layer, an elastic layer stacked on a front side (outer peripheral side) of the base layer, and a release layer with which the elastic layer is coated. In the exemplary embodiment, the fixing belt 610 is provided opposed to a toner image transferred on a sheet P. In the exemplary embodiment, the fixing belt 610 is an endless belt.

The fixing roller 611 is a cylindrical roller. The fixing roller 611 is rotated in a direction of arrow in FIG. 2 by rotating driving force from an unillustrated driving motor. The fixing roller 611 is preheated to a predetermined temperature by halogen heaters 71 disposed therein.

The internal heating roller 612 is a cylindrical roller. The internal heating roller 612 is preheated to a predetermined temperature by halogen heaters 72 disposed therein.

The external heating roller 63 is a cylindrical roller. The external heating roller 63 is preheated to a predetermined temperature by, for example, three halogen heaters 73 disposed therein. In this way, the fixing unit 60 in the exemplary embodiment adopts a structure in which the fixing belt 610 is heated by the fixing roller 611, the internal heating roller 612, and the external heating roller 63.

The peeling pad 64 is a block member having a substantially arc-shaped cross section. The peeling pad 64 is fixed and disposed all over the entire axial area of the fixing roller 611 at a position near and downstream of a region where the pressing roller 62 is in pressure contact with the fixing roller 611 with the fixing belt 610 being disposed therebetween (hereinafter, referred to as a "roll nip N1"). Further, the peeling pad 64 is disposed to uniformly press the pressing roller 62 with the fixing belt 610 being disposed therebetween with a predetermined load along a predetermined widthwise region, and forms a "peeling-pad nip N2" continuing from the roll nip N1.

Next, the pressing roller 62 is formed by stacking a columnar roller serving as a base body, an elastic layer, and a release layer in this order from the base body side. The pressing roller 62 is disposed to move into contact with and away from the fixing belt module 61. When the pressing roller 62 is set to be in contact (pressure contact) with the fixing belt module 61 while pressing the fixing belt module 61, it is rotated in a direction of arrow in FIG. 2 along with the rotation of the fixing roller 611 of the fixing belt module 61 in a direction of arrow in FIG. 2.

Next, a description will be given of toner contained in each developing device 15 in the exemplary embodiment.

In the exemplary embodiment, yellow toner, magenta toner, cyan toner, and black toner are generically referred to as colored toner Tymck.

Clear toner (clear toner) Tt shows a transparent color when fixed on a sheet P. In the exemplary embodiment, the term "transparent" means "transparent to at least visible light." The clear toner Tt transmits light reflected by a back sheet P or other toners. In the exemplary embodiment, the clear toner Tt also serves to give gloss.

In the exemplary embodiment, the clear toner Tt needs to contain a binder resin and a parting agent, and substantially does not contain a colorant. Here, "substantially does not contain" means the degree such that the coloring degree is not conspicuous to the naked eyes.

Metallic-color toner Tg shows a metallic color when fixed on a sheet P. Here, the metallic color is, for example, gold or silver.

In the exemplary embodiment, the metallic-color toner Tg is compounded of metallic pigment having a relatively large particle diameter, such as silver powder or metallic aluminum powder, in addition to a binder resin of synthetic resin, such as styrene or acrylic resin, a colorant, and a compounding agent. Metallic pigment, such as silver powder, has a flat shape, a scaly shape, a disc shape, or a spherical shape. Further, the average particle diameter of the metallic pigment, such as silver powder, is relatively larger than that of normal toner such as yellow, magenta, cyan, and black toners.

The metallic-color toner Tg is not limited to the metallic-color toner containing the metallic pigment (powder) such as silver powder or metallic aluminum powder, and may be a mixture of a colorant and scaly pigment in which a thin inorganic crystalline substrate is coated with a thin film of titanium dioxide, or may contain scaly thin films of metal. In the exemplary embodiment, as the metallic-color toner Tg, a flat metallic-color toner having an average particle diameter relatively larger than that of the colored toner Tymck can be used.

In the exemplary embodiment, clear toner Tt, yellow toner, magenta toner, cyan toner, and black toner, which show colors different from the metallic color, are generically referred to as non-metallic-color toner.

Here, the metallic-color toner Tg is sometimes used alone to express a metallic color (gold or silver), and is also sometimes used to show a colored and metallic color by superimposing the colored toner Tymck thereon. For example, to express a bluish metallic color, cyan toner is superimposed on silver metallic-color toner Tg.

Expression of a colored and metallic color does not exclude stacking colored toner Tymck on a lower side of metallic-color toner Tg. For example, colored toner Tymck, metallic-color toner Tg, and colored toner Tymck may be stacked in order.

In the exemplary embodiment, the image forming unit 11G for the metallic color functions as an example of a first image forming unit. The image forming unit 11Y for yellow, the image forming unit 11M for magenta, the image forming unit 11C for cyan, the image forming unit 11K for black, and the image forming unit 11T for the transparent color function as an example of a second image forming unit for forming a non-metallic-color toner image. Further, the image forming unit 11Y for yellow, the image forming unit 11M for magenta, the image forming unit 11C for cyan, the image forming unit 11K for black, and the image forming unit 11T for the transparent color function as an example of a third image forming unit for forming a colored toner image.

Description of Image Forming Operation

Next, a description will be given of a basic image forming operation in the image forming apparatus 1 according to the exemplary embodiment.

The image forming units 11 in the image forming section 10 form color toner images of a transparent color, black, cyan, magenta, yellow, and a metallic color by an electrophotographic process using the above functional members. The color toner images formed in the image forming units 11 are first-transferred in order onto the intermediate transfer belt 20 by the first transfer rollers 21 and are superimposed to form a synthetic toner image. The synthetic toner image on the intermediate transfer belt 20 is transported along with movement of the intermediate transfer belt 20 (in the direction of the arrow) to the second transfer region 23 where the second transfer roller 22 is disposed.

In a sheet transport system, a sheet P fed out from a paper container 40 by a feed roller is transported along a transport path, and reaches the second transfer region 23. In the second transfer region 23, the synthetic toner image held on the intermediate transfer belt 20 is collectively second-transferred onto the sheet P by a transfer electric field generated by the second transfer roller 22.

After that, the sheet P on which the synthetic toner image is transferred is separated from the intermediate transfer belt 20, and is transported along the transport path to the fixing unit 60. The synthetic toner image on the sheet P transported to the fixing unit 60 is fixed on the sheet P by a fixing process of the fixing unit 60.

In duplex printing, the sheet P having the fixed image formed on its first surface by the above-described process is guided along the transport path, is inverted, and reaches the second transfer region 23 again. In the second transfer region 23, similarly to the first surface, color toner images held on the intermediate transfer belt 20 are collectively second-transferred onto a second surface of the sheet P by a transfer electric field generated by the second transfer roller 22. Similarly to the first surface, a fixed image is formed on the second surface by a fixing process of the fixing unit 60.

Figure 3A:
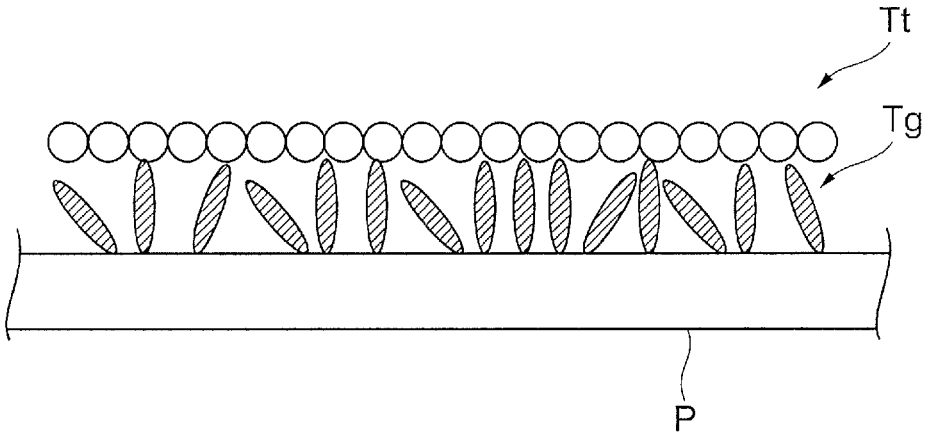
FIGS. 3A and 3B illustrate an example of a stack state of toner on a sheet.
Figure 3B:
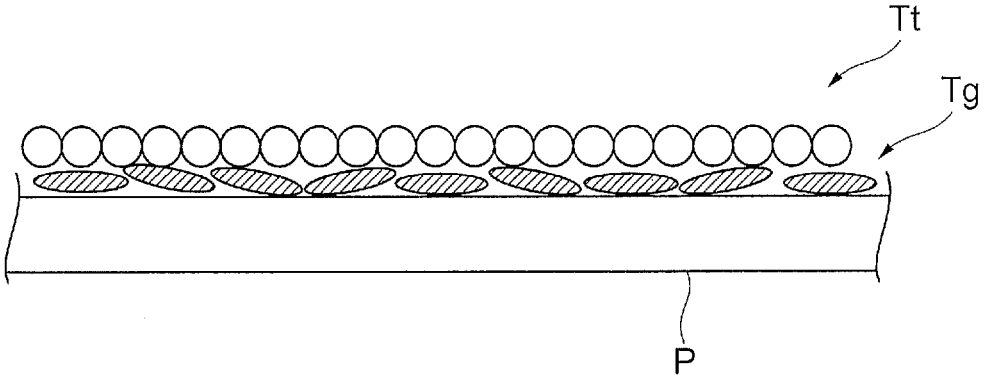

FIGS. 3A and 3B illustrate an example of a toner stack state on the sheet P.

In the exemplary embodiment, as illustrated in FIG. 3A, when a synthetic toner image is transferred on the sheet P, non-metallic-color toner having a color different from the color of metallic-color toner Tg is superimposed on the upper side of the metallic-color toner Tg relative to the sheet P. That is, a process for coating the metallic-color toner Tg with the non-metallic-color toner on the sheet P (hereinafter, referred to as a coating process) is performed.

For example, in the exemplary embodiment, clear toner Tt is superimposed on the upper side of the metallic-color toner Tg on the sheet P. Specifically, an image having a shape similar to that of an image formed as a metallic-color toner image is formed as a clear toner image. Then, the metallic-color toner image and the clear toner image are aligned and superimposed on the intermediate transfer belt 20 to form a synthetic toner image.

Description of Fixing Operation in Fixing Unit

Next, the fixing operation in the fixing unit 60 of the exemplary embodiment will be described.

After a synthetic toner image (unfixed toner image) is electrostatically transferred on the sheet P in the second transfer region 23 (see FIG. 1) in the image forming apparatus 1, the sheet P is transported along the transport path (see FIG. 1) toward the nip N (see FIG. 2) in the fixing unit 60. Then, the unfixed toner image on the surface of the sheet P passing through the nip N is fixed on the sheet P by pressure and heat principally acting on the roll nip N1.

After passing through the roll nip N1, the sheet P is transported to the peeling-pad nip N2. The peeling-pad nip N2 is configurated so that the peeling pad 64 is pressed against the pressing roller 62 and the fixing belt 610 is in pressure contact with the pressing roller 62. Therefore, the roll nip N1 is shaped like a downward convex curve by the curvature of the fixing roller 611, whereas the peeling-pad nip N2 is shaped like an upward convex curve by the curvature of the pressing roller 62.

For this reason, after the sheet P is heated and pressed at the curvature of the fixing roller 611 in the roll nip N1, the traveling direction of the sheet P is changed to an opposite direction by the curvature of the pressing roller 62 in the peeling-pad nip N2. At this time, a minute micro-slip occurs between the toner image on the sheet P and the surface of the fixing belt 610. This reduces the adhesion between the toner image and the fixing belt 610, and the sheet P is brought into a state in which it is easily peeled off from the fixing belt 610.

In the exemplary embodiment, the metallic-color toner Tg is used, as described above. When the fixing unit 60 of the exemplary embodiment is used, the above-described micro-slip (slippage) occurs between the toner image and the surface of the fixing belt 610, so that shear force is applied to the flat metallic pigment. As a result, the metallic pigment steeply standing from the plane of the sheet P when transferred on the sheet P, as illustrated in FIG. 3A, tilts toward the sheet plane, as illustrated in FIG. 3B. That is, the metallic pigment points in the direction along the sheet plane. As a result, when the fixing unit 60 of the exemplary embodiment is used, the luminance of the metallic-color toner Tg is increased further.

On the other hand, when the metallic-color toner Tg is transferred on the sheet P, the metallic pigment in the metallic-color toner Tg steeply stands from the sheet P, as described above. Therefore, when the sheet P on which the metallic-color toner Tg is transferred is pressed while being nipped between the fixing belt 610 and the pressing roller 62, a minute flaw may occur on the surface of the fixing belt 610.

In contrast, in the exemplary embodiment, a toner image formed of non-metallic-color toner, such as clear toner Tt, other than the metallic-color toner is superimposed on the metallic-color toner Tg. That is, the metallic-color toner image is coated with the non-metallic-color toner image on the sheet P. This suppresses damage that may occur on the surface of the fixing belt 610 when the fixing belt 610 applies pressure to the metallic-color toner Tg.

Description of Coating Process

Next, the coating process will be described in detail.

Figure 4:
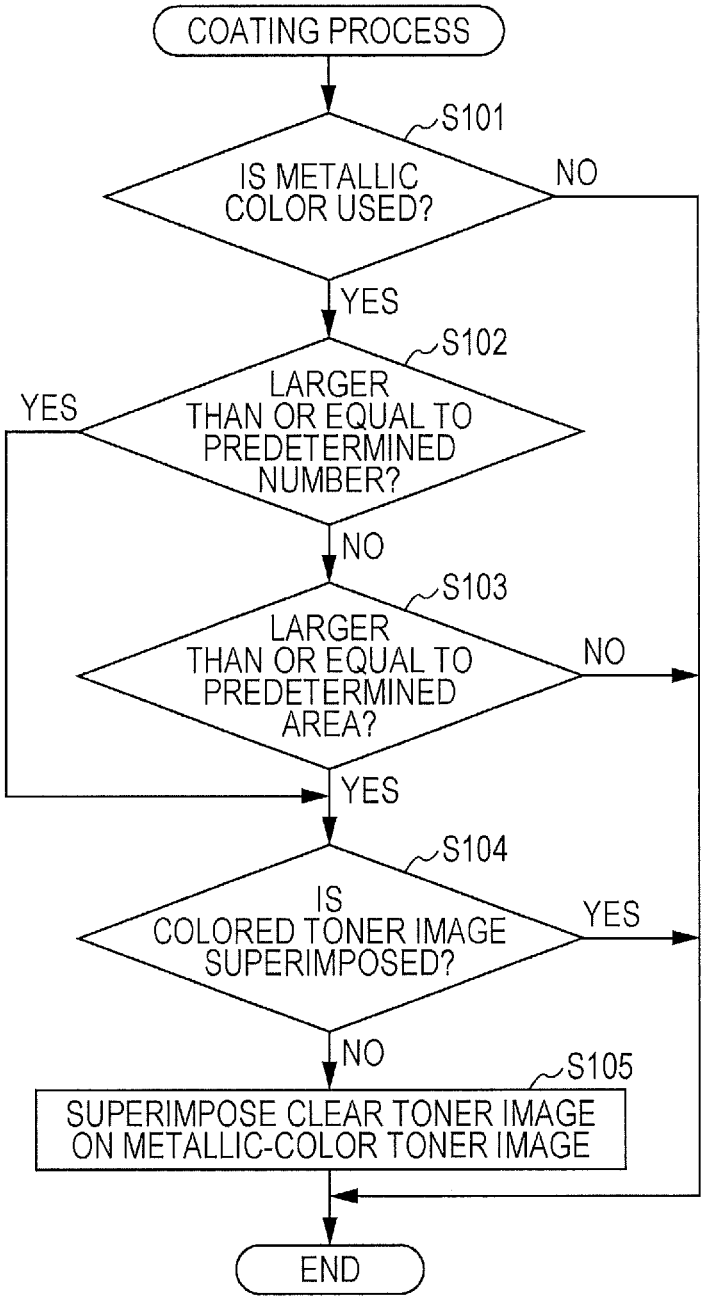
FIG. 4 is a flowchart of a coating process in the exemplary embodiment.

FIG. 4 is a flowchart of the coating process in the exemplary embodiment.

Figure 5:
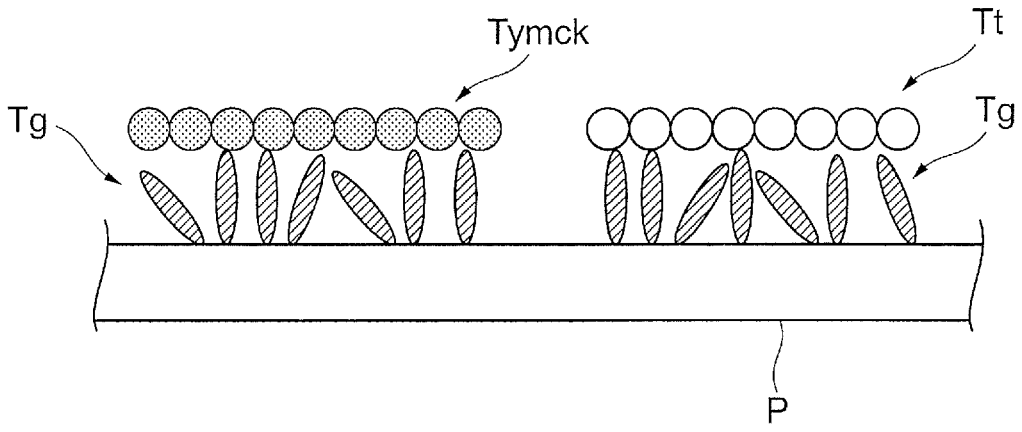
FIG. 5 is a conceptual view illustrating the relationship among metallic-color toner, colored toner, and clear toner on the sheet.

FIG. 5 is a conceptual view illustrating the relationship among metallic-color toner Tg, colored toner Tymck, and clear toner Tt on a sheet P.

The coating process is carried out by the control of the controller 50 over the image forming units 11 and the intermediate transfer belt 20.

First, it is determined whether or not to perform image formation using a metallic color on a sheet P serving as an object on which an image is to be formed (Step (hereinafter referred to as S) 101). When image formation using the metallic color is not performed (No in S101), the process is finished.

Next, when image formation using the metallic color is performed (Yes in S101), it is determined, on the basis of the number of recording materials on which metallic-color toner Tg is to be transferred, whether or not to superimpose clear toner Tt on the metallic-color toner Tg. In the exemplary embodiment, it is determined whether or not the number of successive sheets P, on which the metallic-color toner Tg is to be transferred, is larger than or equal to a predetermined number (S102).

When the number of successive sheets P, on which the metallic-color toner Tg is to be transferred, is larger than or equal to the predetermined number in S102 (Yes in S102), the process proceeds to S104.

Determining whether or not to perform coating with the clear toner Tt on the basis of the number of recording materials on which metallic-color toner Tg is transferred may be made according to not only the number of successive recording materials on which the metallic-color toner Tg is transferred, but also, for example, the number of sheets P on which the metallic-color toner Tg is transferred, of a fixed number of sheets P subjected to image formation. That is, the metallic-color toner Tg is coated with the clear toner Tt in a situation where the use frequency of the metallic-color toner Tg is high in a certain period.

As described above, when the metallic-color toner Tg is fixed, it may damage the fixing belt 610. However, the surface of the fixing belt 610 is easily recovered from damage by fixing a toner image containing no metallic-color toner Tg. Accordingly, the metallic-color toner Tg is coated with clear toner Tt in the situation where the use frequency of the metallic-color toner Tg is high. In contrast, in a situation in which the use frequency of the metallic-color toner Tg is low, coating with the clear toner Tt is not performed to suppress consumption of the clear toner Tt.

On the other hand, when the number of successive sheets P on which the metallic-color toner Tg is transferred is smaller than the predetermined number (No in S102), it is determined, on the basis of the area on the sheets P where the metallic-color toner Tg is transferred, whether or not to superimpose the clear toner Tt on the metallic-color toner Tg. In the exemplary embodiment, it is determined whether or not the area of the metallic-color toner Tg on the sheet P is larger than or equal to a predetermined area (S103).

When the area of the metallic-color toner Tg on the sheet P is larger than or equal to the predetermined area (Yes in S103), the process proceeds to S104. In contrast, when the area of the metallic-color toner Tg on the sheet P is smaller than the predetermined area (No in S103), the process is finished.

First, when the area of the metallic-color toner Tg on the sheet P is large, the region of the fixing belt 610 in the fixing unit 60 to be damaged is also large. When the region of the fixing belt 610 to be damaged increases, the influence on other images to be fixed later increases. Accordingly, in the exemplary embodiment, when the area of the metallic-color toner Tg on the sheet P is large, the metallic-color toner Tg is coated with the clear toner Tt. In contrast, when the area of the metallic-color toner Tg is small, the metallic-color toner Tg is not coated with the clear toner Tt to suppress consumption of the clear toner Tt.

Determining whether or not to superpose the clear toner Tt on the basis of the region where the metallic-color toner image is formed may be made according to not only the area of the region, but also, for example, the length of the metallic-color toner image on the sheet P. Particularly when the length of the metallic-color toner image in the transport direction of the sheet P is longer than or equal to a predetermined length, the metallic-color toner Tg may be coated with the clear toner Tt.

A metallic-color toner image is continuously formed in one direction on a sheet P, for example, when a gold ornament frame for a commendation is formed using metallic-color toner Tg. In this case, since a portion of the fixing unit 60 opposed to the metallic-color toner image concentrates at a specific position, the load is high at the specific position. Accordingly, when the length of the metallic-color toner image is longer than or equal to the predetermined length in one direction, the metallic-color toner Tg is coated with the clear toner Tt.

Next, when the number of successive sheets P on which the metallic-color toner Tg is transferred is more than or equal to the predetermined number in S102 (Yes in S102) or when the area of the metallic-color toner image on the sheets P is more than or equal to the predetermined area (Yes in S103), it is determined whether or not to superimpose a colored toner image on the metallic-color toner image (S104).

When the colored toner image is superimposed on the metallic-color toner image (Yes in S104), the process is finished. In contrast, when the colored toner image is not superimposed on the metallic-color toner image (No in S104), a clear toner image is superimposed on the metallic-color toner image (S105).

When the metallic-color toner image is coated with colored toner Tymck, since the colored toner Tymck is held between the fixing belt 610 and the metallic-color toner Tg, the fixing belt 610 is protected by the colored toner Tymck. Accordingly, in the exemplary embodiment, as illustrated in FIG. 5, when the metallic-color toner Tg is coated with the colored toner Tymck, it is not coated with the clear toner Tt to suppress consumption of the clear toner Tt. In contrast, when the metallic-color toner Tg is not coated with the colored toner Tymck, it is coated with the clear toner Tt.

As described above, in the exemplary embodiment, it is determined whether or not to coat the metallic-color toner Tg with the clear toner Tt, on the basis of the conditions such as the number of sheets P on which the metallic-color toner Tg is transferred, the area of the metallic-color toner image on the sheets P, and the presence or absence of the colored toner Tymck superimposed on the metallic-color toner image.

While all of the number of sheets P on which the metallic-color toner Tg is transferred, the area of the metallic-color toner image on the sheets P, and the presence or absence of the colored toner Tymck superimposed on the metallic-color toner image are adopted as the conditions in the above-described exemplary embodiment, it may be determined whether or not to coat the metallic-color toner Tg with the clear toner Tt, according to individual conditions.

As a condition for superimposing the clear toner Tt on the metallic-color toner Tg, the image ratio or density of the metallic-color toner image on the sheet P may be used. Specifically, when the image ratio serving as the number of pixels included per unit area of the metallic-color toner image formed on the sheet P is higher than or equal to a predetermined image ratio, the metallic-color toner Tg is coated with the clear toner Tt. Alternatively, when the density of the metallic-color toner image formed on the sheets P is higher than or equal to a predetermined density, the metallic-color toner Tg is coated with the clear toner Tt.

For example, when the amount of colored toner Tymck that coats the metallic-color toner Tg is smaller than a predetermined amount, clear toner Tt may be superimposed on the metallic-color toner Tg in addition to the colored toner Tymck in order to supplement the function of protecting the fixing belt 610 by coating with the colored toner Tymck.

While the shape of the clear toner image coincides with the shape of the metallic-color toner image when the metallic-color toner Tg is coated with the clear toner Tt in the exemplary embodiment, the present invention is not limited thereto. For example, a clear toner image may be formed over the entire sheet P, regardless of the shape of the metallic-color toner image. Alternatively, the metallic-color toner image may be partly coated with the clear toner Tt.

While toner images of plural colors are combined on the intermediate transfer belt 20 and are then collectively transferred onto a sheet P in the exemplary embodiment, the present invention is not limited to this manner. For example, the contents of the above-described exemplary embodiment are also applicable to an image forming apparatus in which toner images of plural colors are transferred in order onto a sheet P.

The image forming process and the coating process in the above-described exemplary embodiment are carried out by cooperation of software and hardware resources. That is, an unillustrated CPU in the controller 50 provided in the image forming apparatus 1 executes a program that fulfills the functions of the image forming process and the coating process, and fulfills these functions.

Hence, the program can be regarded as causing the computer to fulfill the function of forming a metallic-color toner image having a metallic color, the function of forming a non-metallic-color toner image having a color different from the metallic color, and the function of transferring a toner image onto a sheet P so that the non-metallic-color toner image is superimposed on the upper side of the metallic-color toner image on the sheet P.

The program that carries out the exemplary embodiment can be provided not only by a communication device but also by being stored in a recording medium such as a CD-ROM.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that forms a metallic-color toner image by using a metallic-color toner;

a second image forming unit that forms a clear toner image by using a non-metallic-color toner having an average particle diameter relatively smaller than that of the metallic-color toner;

a transfer unit that transfers the toner images onto a recording material so that the clear toner image is superimposed on an upper side of the metallic-color toner image on the recording material when an area of the metallic-color toner image on the recording material is larger than or equal to a predetermined area; and a fixing unit that fixes the toner images transferred onto the recording material on the recording material.

2. The image forming apparatus according to claim 1, wherein the second image forming unit forms the clear toner image having a transparent color.

3. The image forming apparatus according to claim 2, further comprising:

a third image forming unit that forms a colored toner image having any of yellow, magenta, cyan, and black colors, wherein the transfer unit does not superimpose the clear toner image on a portion of the recording material where the colored toner image is superimposed on the metallic-color toner image.

4. The image forming apparatus according to claim 2, wherein the transfer unit superimposes the clear toner image on the metallic-color toner image, and wherein the clear toner image has a shape corresponding to a shape of the metallic-color toner image.

5. A non-transitory computer readable medium storing a program causing a computer to execute a process comprising:

forming a metallic-color toner image by using a metallic-color toner;

forming a clear toner image by using a non-metallic-color toner having an average particle diameter relatively smaller than that of the metallic-color toner; and transferring the toner images on a recording material so that the clear toner image is superimposed on an upper side of the metallic-color toner image on the recording material when an area of the metallic-color toner image on the recording material is larger than or equal to a predetermined area; and fixing the toner images transferred onto the recording material on the recording material.

6. An image forming apparatus comprising:

a first drum that forms a metallic-color toner image having a metallic color;

a second drum that forms a clear toner image having a color different from the metallic color; and a roller that transfers the toner images onto a recording material so that the clear toner image is superimposed on an upper side of the metallic-color toner image on the recording material when an area of the metallic-color toner image on the recording material is larger than or equal to a predetermined area.

7. An image forming apparatus comprising:

a first image forming unit that forms a metallic-color toner image by using a metallic-color toner;

a second image forming unit that forms a non-metallic-color toner image by using a non-metallic-color toner having an average particle diameter relatively smaller than that of the metallic-color toner;

a transfer unit that transfers the toner images onto a recording material so that the non-metallic-color toner image is superimposed on an upper side of the metallic-color toner image on the recording material, when an area of the metallic-color toner image on the recording material is larger than or equal to a predetermined area; and a fixing unit that fixes the toner images transferred onto the recording material on the recording material.

* * * * *